US008631754B1

(12) United States Patent
Sax, Sr. et al.

(10) Patent No.: US 8,631,754 B1
(45) Date of Patent: Jan. 21, 2014

(54) ARTICULATING BASE WATER SPORTS TOWER

(76) Inventors: Warren Scott Sax, Sr., Sacramento, CA (US); Donn Van Dusen, Yuba City, CA (US)

( * ) Notice: Subject to any disclaimer, the term of this patent is extended or adjusted under 35 U.S.C. 154(b) by 162 days.

(21) Appl. No.: 13/065,630

(22) Filed: Mar. 25, 2011

Related U.S. Application Data

(60) Provisional application No. 61/341,125, filed on Mar. 26, 2010.

(51) Int. Cl.
*B63B 17/00* (2006.01)

(52) U.S. Cl.
USPC ..... 114/364; 114/253

(58) Field of Classification Search
USPC ..... 114/253, 343, 361, 364
See application file for complete search history.

(56) References Cited

U.S. PATENT DOCUMENTS

| | | | | |
|---|---|---|---|---|
| 5,044,298 | A * | 9/1991 | Pepper et al. | 114/361 |
| 6,792,888 | B1 * | 9/2004 | Metcalf | 114/364 |
| 6,986,321 | B2 * | 1/2006 | Metcalf | 114/364 |
| 2009/0178604 | A1 * | 7/2009 | McKeand | 114/343 |

* cited by examiner

*Primary Examiner* — Lars A Olson
(74) *Attorney, Agent, or Firm* — Heisler & Associates

(57) ABSTRACT

A water sports tower is pivotably attached to a watercraft through an articulating base structure. A joint is supplied joining lower ends of uprights of the tower to gunwales of the watercraft. The joints are configured to join each of the lower ends of the uprights through the joint to the gunwale. The joint includes a follower element opposite a reference element with the reference fixed to the gunwale of the watercraft and the follower element fixed to the lower ends of the uprights of the tower. A pair of links, including a short link and a long link, join portions of the reference and portions of the follower. A driver is preferably provided between at least two of the elements of the joint, such as between the follower and the reference. The driver can supply an additional force to assist in raising and lowering of the tower relative to the watercraft.

14 Claims, 3 Drawing Sheets

10
20
60
70
30
40
50
16
A
14
12
G

J
H
F

ARTICULATING BASE WATER SPORTS TOWER

CROSS-REFERENCE TO RELATED APPLICATIONS

This application claims benefit under Title 35, United States Code §119(e) of U.S. Provisional Application No. 61/341,125 filed on Mar. 26, 2010.

FIELD OF THE INVENTION

The following invention relates to collapsible towers for watercraft and other vehicles. More particularly, this invention relates to joints for pivotably attaching towers to vehicles such as watercraft.

BACKGROUND OF THE INVENTION

A common occurrence in recent times is for watercraft to be configured with water sport towers. The tower extends up from the gunwales of the watercraft and are joined together over a central portion of the watercraft. An attachment point (or points) are generally provided at an uppermost portion of the tower. This attachment point is utilized for attaching tow ropes to enhance the experience enjoyed by those being towed behind the watercraft.

Most commonly, such towers are collapsible so that the tower does not always extend up high when not in use. For instance, such collapsibility can be beneficial when towing the boat, when storing the boat in a storage building (e.g. a garage) and when it is necessary for the watercraft to fit under an overhead structure (e.g. a low bridge over a waterway).

To keep the tower stable and also facilitate such collapsing, some towers have a two point mounting system that secures the lower end of the tower to the starboard gunwale at two points and to the port gunwale at two points. These two points include a pivoting support and a removably attachable support. The tower is pivotably attachable to the watercraft at the pivoting support and removably attachable to the watercraft at the removable attachment point. Details of such a tower are shown in U.S. Pat. No. RE37,823, incorporated herein by reference in its entirety The further these two points are spaced apart, the more evenly the load can be distributed between these two points. Such spacing helps to minimize the strength requirements that must be built into the tower and portions of the watercraft adjacent these support points. However, such spacing is undesirable when the tower is collapsed. The removably attachable support point of the tower moves upward while the tower pivots about the pivoting support. Thus, the degree of overall collapsibility is diminished and the collapsed tower still adds significant height to the watercraft. Other towers have a single point mounting on either side of the watercraft.

Furthermore, with prior art collapsible towers the strength required to raise and lower the tower is substantial and can present an obstacle to raising and lower the tower. Furthermore, such collapsible towers often rest upon other portions of the watercraft, such as the windshield or other portions of the watercraft. The tower often vibrates or bounces undesirably potentially damaging the watercraft and/or the tower. Accordingly, a need exists for a joint for collapsibly attaching a tower of a watercraft which exhibits a low profile when collapsed, provides a high strength joint, and enhances the ease with which the tower can be raised and lowered.

SUMMARY OF THE INVENTION

With this invention a joint is provided which acts as a pivoting support for a watercraft tower. Two such joints are provided as mirror images of each other at opposite gunwales on the starboard and port side of the watercraft. Each joint includes a reference element on one side of the joint which would be secured to the watercraft. The reference portion of the joints, while typically fastened to each gunwale, could be fastened to other portions of the watercraft as well, including points forward of the windshield (or general area forward of a driver's position if no windshield is provided), points on the windshield itself, or points to a rear of the windshield but inboard of the gunwales.

The joint itself is generally in the form of a four bar linkage with the reference portion acting as one of the four elements of the mechanism. A follower element is provided opposite the reference element. The follower is affixed to a lower portion of the tower in a fixed manner. Hence, when the follower rotates relative to the reference, the entire tower rotates relative to the reference.

Two links, including a short link and a long link, join the reference to the follower. Each of these links, as well as the follower and the reference, are substantially rigid elements typically formed of machined aluminum or steel, but potentially formed from other metals or other materials which are substantially rigid and have the strength characteristics required to support the tower above the reference portion of the joint.

The links could be singular or compound in nature. For instance, the short link could be two separate plates of metal with a gap therebetween and with the reference and follower having attachment points that attach to the short link, between these two plates that together form the short link. Alternatively, the short link could be a singular link and the follower and reference could be in the form of dual plates or otherwise formed as dual structures that straddle either side of the singular short link. As a still further alternative, each of the links, as well as the follower reference could be singular in form and joints between the links could be merely in the form of lap joints with for instance a singular short link and a singular reference and a bolt passing through both the short link and the reference to join the two elements together.

Each of the elements in the joint are configured to be securely attached to each other, but in a pivotable fashion. This pivotability is typically facilitated by the attachment being in the form of holes provided at ends of each of the elements and with bolts, pins or other rotational bearing structures passing through these holes in the ends and fastened in place. Thus, translation between adjacent elements is eliminated and rotation between adjacent elements is restricted to rotation within a single plane perpendicular to the pivoting access passing through the bolt or other rotational support element.

The two links are preferably of different length. By sizing the lengths of the links one can control the amount of rotation that the tower experiences. It is also important to note that with the short link being shorter than the long link, and as particularly configured, the long link only moves a small amount during movement of the tower. Thus, the height of the joint and hence the height of the tower when in the collapsed configuration remains substantially the same and is not increased (or only increased minimally) in any way as the tower is collapsed.

When the entire joint is sized with a height similar to that of the windshield of the watercraft, the entire tower can be lowered so that the watercraft maintains a maximum height no higher than the windshield, and eliminating the problem of a collapsed tower having a greater height above the watercraft than other portions of the watercraft, and inhibiting the locations where the watercraft can effectively travel without running into overlying structures.

It should be recognized that the elements, although shown as linear, could have various different contours. Also, the lengths of the various different elements could be modified somewhat. It is also conceivable that a number of elements greater than four could be utilized with sufficient constraint so that the entire joint acts as a kinematic linkage of a four bar variety. At a minimum, the joint should be considered to have at least four elements, but could conceivably have more.

Most preferably, a driver is provided between the reference element and the follower element of the joint. This driver is a load assist device having a variable length and extending between the reference and the follower. The load assist driver is provided to decrease the force required to raise or lower the tower to make it easier to move the tower. Furthermore, vibration can to some extent be dampened through utilization of a driver having vibration dampening characteristics.

The driver can have a variety of different configurations to function effectively according to this invention. In one form of the invention, the driver would merely be in the form of a spring, such as a linear compression spring. When the tower is in its up position the spring might be provided substantially at rest. As the tower is moved down this spring would be compressed so that the weight of the tower need not be carried entirely by an individual moving the tower down. Rather, to some extent the tower is being carried by force delivered by the spring within the driver.

When the tower is in its collapsed position, this spring would be fully compressed. Thus, when a user wishes to raise the tower force required to raise the tower is partially provided by the user, but also largely provided by the driver spring. If desired, a dampener, such as a shock absorber could also be provided as a portion of the drive to minimize vibration of the tower relative to the watercraft. If the tower is not particularly heavy and vibration concerns are greater than load assist concerns, the driver could be fitted with a damper and no spring.

Other elements other than springs could alternatively be provided as load assist devices as is known in the art. For instance, a resilient element could be utilized, a compressed air cylinder could be utilized, or some other passive mechanical structure which stores energy when compressed and releases energy when expanded, could be utilized.

As another alternative, the driver could be active in form and supply a force when activated and thus actively assist in raising and lowering the tower. For instance, the driver could be configured as a form of jack, such as a screw jack, and a crank could be provided or some other jack manipulation tool, which a user could manipulate to operate the driver in the form of a jack or screw to raise the tower and lower the tower relative to the watercraft. As another alternative, an electric motor could be coupled to the jack so that a switch would merely be pressed to activate the electric motor and then drive the jack to raise and lower the tower.

The driver could also be configured as a hydraulic cylinder and an appropriate source of hydraulic pressure, such as provided by a hydraulic pump, and associated valves, could deliver hydraulic fluid to a hydraulic cylinder acting as the driver to modify the length of the driver and move the follower and associated tower relative to the reference and associated watercraft. The driver could also be a pneumatic cylinder configured similarly to a hydraulic cylinder, but appropriately modified to account for the differences between compressible and incompressible fluids, as is known in the art.

While the attachment points for the driver are shown generally as midpoints on the reference and follower, attachment points could be varied to a variety of different positions to adjust the force being applied and the amount of travel between compressed and extended configurations for the driver.

OBJECTS OF THE INVENTION

Accordingly, a primary object of the present invention is to provide a watercraft with associated tower which tower can be easily and securely raised and lowered between a lowered storage position and a raised deployed position.

Another object of the present invention is to provide a collapsible tower which keeps all of the lower ends of upright portions of the tower coupled to the watercraft or other vehicle at all times.

Another object of the present invention is to provide a collapsible tower for a watercraft which maintains a low profile when the tower is collapsed.

Another object of the present invention is to provide a collapsible tower which is easy to raise and lower.

Another object of the present invention is to provide a tower for a watercraft which avoids bouncing and damage to the watercraft or other vehicle supporting the tower when the tower is in a collapsed position.

Another object of the present invention is to provide a method for simply and easily raising and lowering a watercraft tower.

Another object of the present invention is to provide a watercraft tower which can have an energy required to raise and lower the tower at least partially supplied by a driver so that an individual does not need to exert as much as energy in raising and lowering the tower, and potentially not requiring any energy at all.

Other further objects of the present invention will become apparent from a careful reading of the included drawing figures, the claims and detailed description of the invention.

DESCRIPTION OF THE PREFERRED EMBODIMENT

Figures 4, 5:
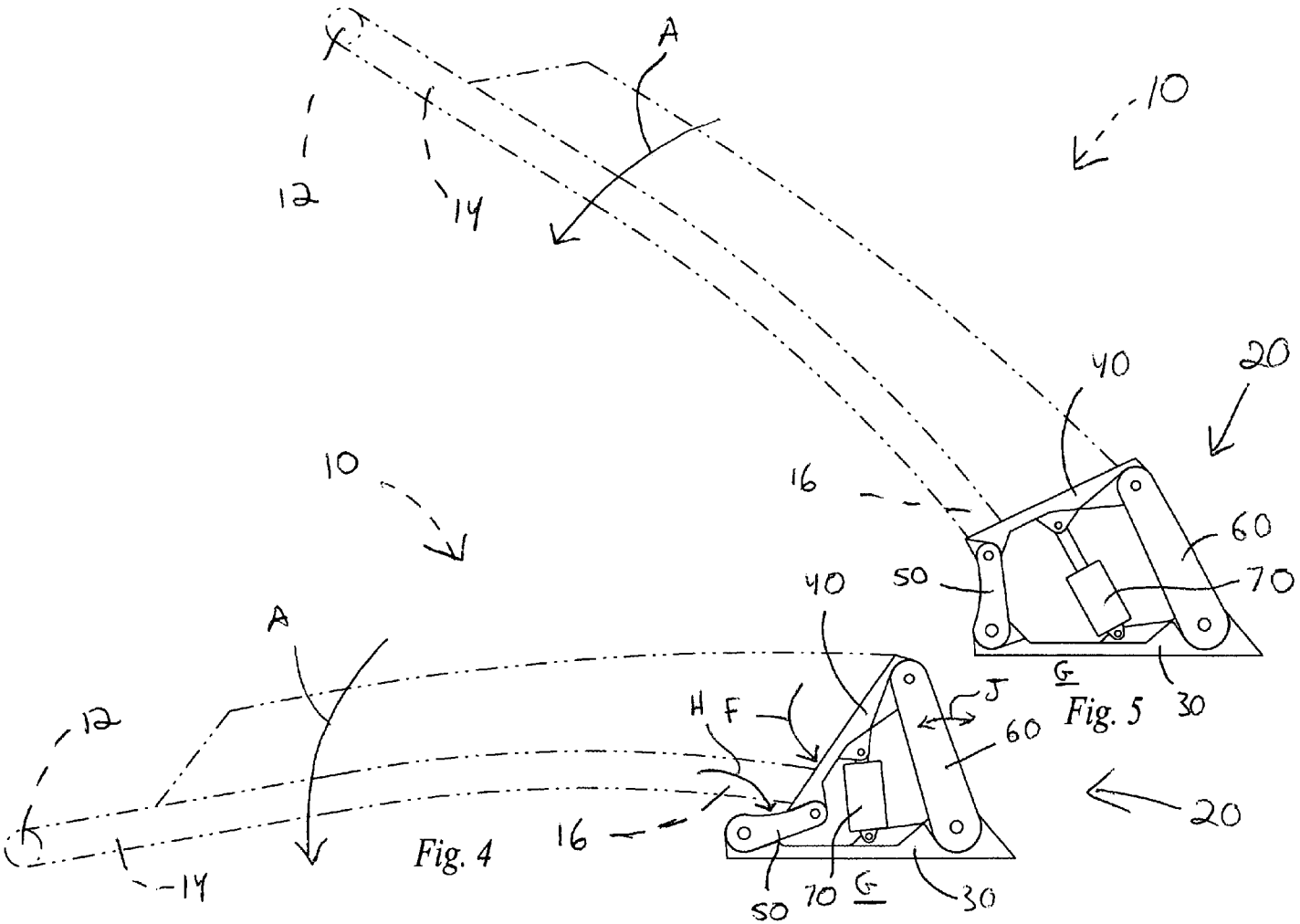
FIG. 4 is a side elevation view of the joint and with an associated tower shown in broken lines, showing the tower in a collapsed orientation.
FIG. 5 is a side elevation view similar to that which is shown in FIG. 4, but with the tower in an elevated position.

Referring to the drawings, wherein like reference numerals represent like parts throughout the various drawing figures, reference numeral 10 is directed to a tower (FIGS. 1, 4 and 5) attachable to a watercraft W or other vehicle, such as through gunwales G on lateral sides of the watercraft W. The tower 10 is collapsible (along arrow A of FIGS. 1, 4 and 5) from a deployed elevated orientation (FIG. 5) to a collapsed lowered orientation (FIG. 4). A joint 20 provides for articulation of the tower 10 relative to the watercraft W or other vehicle, and maintains the tower 10 with a low profile when collapsed and is coupled to various different lower ends 16 of uprights 14 of the tower 10, both when the tower 10 is in a raised orientation and in a lowered orientation.

Figure 1:
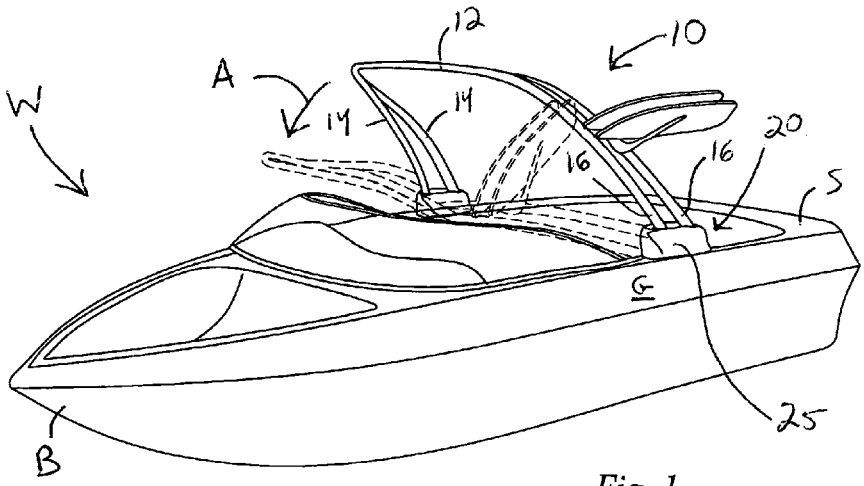
FIG. 1 is a perspective view of a watercraft including a water sports tower thereon configured according to this invention and with the tower shown in an elevated position in solid lines and in a collapsed position in broken lines.

In essence, and with particular reference to FIGS. 4 and 5, basic details of the tower 10 and joint 20 are described, according to this most preferred embodiment. The tower 10 generally includes a cross member 12 supported between at least two uprights 14 which extend down from the cross member 12 to lower ends 16 (see also FIG. 1). The joint 20 pivotably connects the lower ends 16 of the uprights 14 of the tower 10 to the gunwales G on each lateral side of the watercraft W or other vehicle (FIG. 1). This joint 20 preferably is generally in the form of a four-bar linkage including a reference element 30, a follower element 40, at least one short link 50 and at least one long link 60. The reference 30 is adapted to be affixed to an adjacent gunwale G of the watercraft W and could be replaced by a portion of the gunwale G itself. The follower element 40 is configured to be attachable to the lower ends 16 of the uprights 14 of the tower 10. The short links 50 and long link 60 join ends of the reference element 30 to ends of the follower element 40 to complete the overall four-bar linkage. A driver 70 is preferably provided between at least two of the links. The driver 70 supplies at least some energy, especially when the tower 10 is being transitioned from a collapsed orientation to a raised orientation, such that energy required to raise the tower 10 (in a direction opposite arrow A of FIGS. 4 and 5) is minimized.

More specifically, and with particular reference to FIGS. 1, 4 and 5, specific details of the tower 10 are described, according to a most preferred embodiment. The towers 10 can come in a variety of different configurations. In one extreme, the tower 10 can merely be a single curving inverted "U-shaped" structure. In other extremes, the tower 10 can be in the form of multi-member structures on lateral sides and interconnecting cross members extending between the two truss-like side portions. Often, these two side portions of the tower 10 include multiple uprights 14 including a forward most upright 14 and a rearward most upright 14 which each connect separately to the gunwale G of the watercraft W. If a single upright 14 is provided on each side of the tower 10, it typically has a fore and an aft connection point. Upper portions of these uprights 14 can either be affixed to the cross member 12 or formed with the cross member 12 and merely have a bend in the material forming the cross member 12 and the uprights 14. With this invention, the lower ends 16 of each of the uprights 14 on each lateral side of the tower 10 are fixed to a common follower element 40 providing a portion of the joint 20, such that none of the lower end 16 of the uprights 14 are ever released from the joint 20, but rather remain fixed to the joint 20 and fixed to the gunwale G through the joint 20. In the embodiment shown, two uprights 14 are provided on each lateral side of the tower.

With particular reference to FIGS. 2, 3, 6 and 7, particular details of the joint 20 are described according to a most preferred embodiment. The joint 20 provides an articulating connection between the tower 10 and the gunwales G of the watercraft W. These joints 20 include one joint 20 on each lateral side of the tower 10. Each joint 20 is preferably a mirror image of the other and optionally is contained within a shroud 25 which hides the joint 20 and prevents injury to users adjacent the joints 20. This shroud 25 does not hinder motion of the tower 10 about the joint 20.

The joint 20 is preferably generally in the form of a kinematic four-bar linkage. This four-bar linkage includes a reference element 30 opposite a follower element 40. At least one short link 50 and at least one long link 60 join the follower element 40 to the reference element 30. Additional elements could also be provided, such as configuring the joint 20 as a five-bar linkage or with additional links, provided they are sufficiently constrained so that the overall motion of the tower 10 relative to the watercraft W or other support vehicle can be appropriately controlled.

The reference element 30 is an elongate rigid structure which provides an interface between the joint 20 and the gunwale G or other lateral side of the watercraft W or other vehicle. This reference 30 generally includes an upper surface 32 opposite a lower surface 34 and extends from a forward end 36 to a rearward end 38. The lower surface 34 defines that portion of the reference element 30 which is affixed to the gunwale G.

The upper surface 32 includes a tab 33 thereon to which portions of a driver 70 can be attached. A forward end 36 includes a bearing 37 thereon. This bearing 37 has a hole for pivotable support of a pin 55 also passing through a short link 50 to pivotably attach a portion of at least one short link 50 to the forward end 36 of the reference element 30. A hump 39 is provided at the rearward end 38 of the reference 30. The hump 39 also provides a hole which pivotably supports a pin 65 to which at least one long link 60 is pivotably connected. The tab 33 can be provided at a midpoint or some other location between the forward end 36 and rearward end 38 of the reference element 30. In one embodiment a portion of the gunwale G could function as the reference element.

Figure 2:
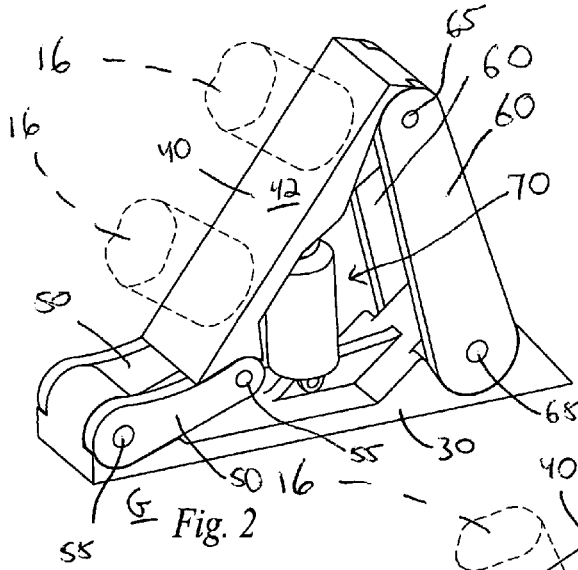
FIG. 2 is a perspective view of a joint for attaching the water sports tower to gunwales of the watercraft according to a preferred embodiment of this invention.
Figure 3:
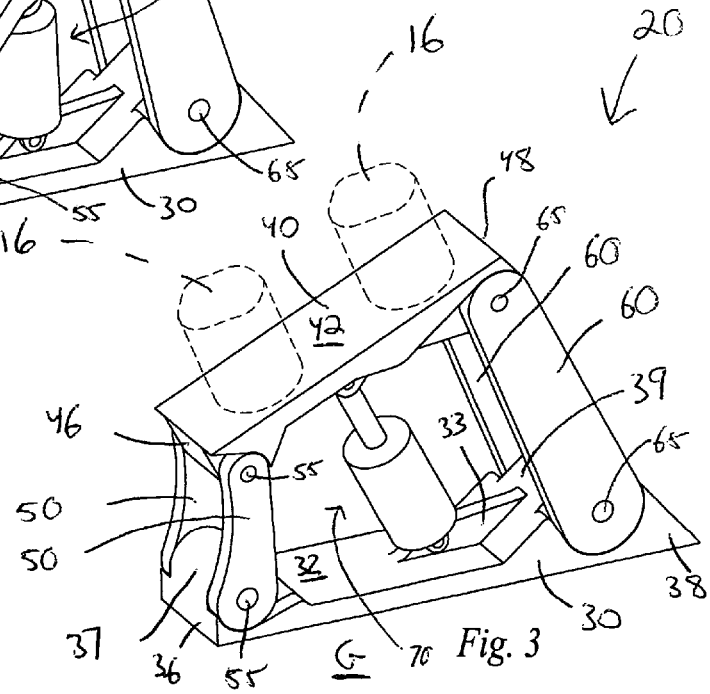
FIG. 3 is a perspective view similar to that which is shown in FIG. 2, but with the joint shown as it is configured when the tower is elevated, rather than collapsed as depicted in FIG. 2.

The follower element 40 is an elongate rigid element which joins the joint 20 to the lower ends 16 of the uprights 14 (FIGS. 2 and 3). This follower element 40 includes a top surface 42 opposite a bottom surface 44 and extends from a front end 46 to a rear end 48. At least one rib 45 is provided extending from the bottom surface 44 (FIGS. 6 and 7) to which portions of the driver 70 can be attached. The top surface 42 is preferably substantially planar and supports the lower end 16 of the cross member 12 adjacent thereto. Such support is preferably by affixation, such as by welding or secure fastening. This interconnection of the lower ends 16 of the tower 10 to the follower element 40 is preferably permanent affixation such that these lower ends 16 of the uprights 14 of the tower 10 remain attached to the watercraft W through the joints 20 at all times. The forward end 46 connect via a pin 55 to the short link 50 and the rear end 48 of the follower element 40 supports a pin 65 for pivotable attachment to at least one long link 60.

The at least one short link 50 is depicted herein as an alternative where it is configured as a pair of substantially parallel short links 50 (FIGS. 2 and 3) which each connect to opposite ends of a common pin 55 at both an upper end 52 and a lower end 54. The upper ends 52 of each short link 50 are thus pivotably attached to the follower element 40 and the lower ends 54 of each of the short links 50 are pivotably attached to the forward end 36 of the reference surface 30. These two short links 50 could conceivably be joined together at mid-portions thereof if desired. It is preferable that a single short link 50 be provided which is either at an outer side or inner side of the joint 20. Also, a single short link 50 could be provided at a midpoint of the joint 20 and a pair of follower elements 40 and/or reference elements 30 could be provided on inside and outside edges of the joint 20.

The at least one long link 60 is depicted in this embodiment as a pair of substantially parallel long links 60 (FIGS. 2 and 3). Each long link 60 has a top end 62 opposite a bottom end 64. The top ends 62 are pivotably attached to the rear end 48 of the follower element 40 through a common pin 65. The bottom ends 64 of each long link 60 are pivotably attached to the rearward end 38 of the reference element 30 through a common pin 65 passing through the hump 39 in the reference element 30. The long links 60 are preferably longer than the short links 50. Because the long links 60 are longer than the short links 50, the long links pivot less (along arrow J of FIG. 6) than the short links 50 (along arrow H of FIG. 6) when the follower element 40 pivots (along arrow F of FIG. 6) relative to the reference element 30. Such range of motion can be seen by comparing FIG. 6 to FIG. 7. The position of the tower 10 for these two orientations of the joint 20 are best seen in FIGS. 4 and 5. As with the short link 50 it is preferable that a single long link 60 is provided for each joint 20.

While these various elements of the four-bar linkage making up the joint 20 are shown with these particular geometric configurations, the shapes and sizes of these various elements of the four-bar linkage comprising the joint 20 could be adjusted to meet various different design criteria, both functional and aesthetic. While the links 50, 60 are shown pivotably attached to ends of the reference element 30 and follower element 40, these pivotable attachment points could be spaced from ends of the reference element 30 and follower element 40, so long as they are not at a common location on the reference element 30 and follower element 40.

Figure 6:
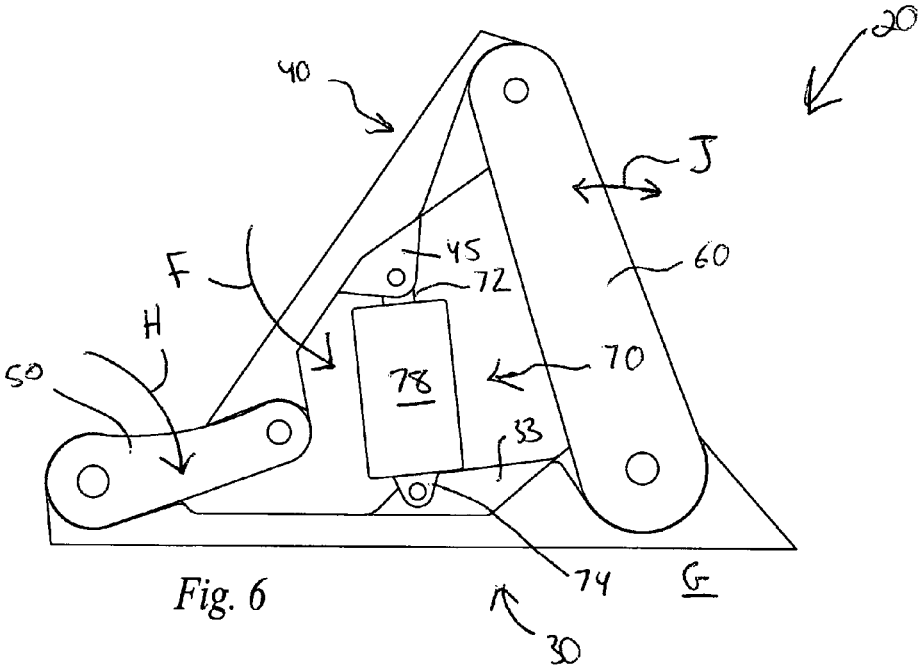
FIG. 6 is a side elevation view of the joint for the tower of this invention and with the joint in a position corresponding with the tower being in a collapsed orientation.
Figure 7:
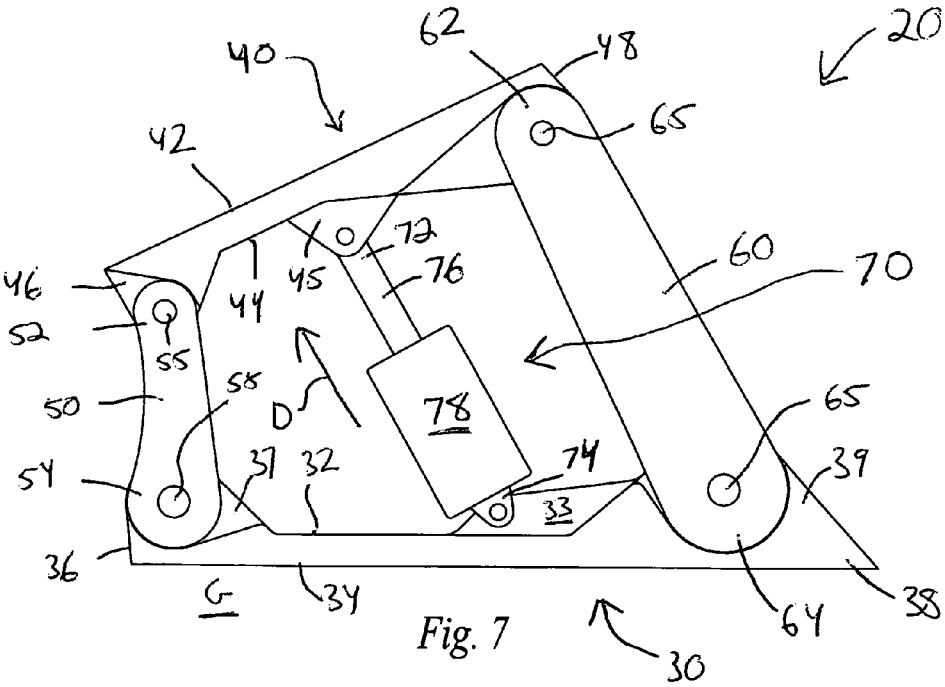
FIG. 7 is a side elevation view of the joint of FIG. 6, but with the joint having transitioned to an orientation associated with the tower being in an elevated orientation.

With particular reference to FIGS. 6 and 7, details of the driver 70 are described, according to a most preferred embodiment. The driver 70 is configured to apply a force between the reference element 30 and follower element 40, or more generally can be described as applying a force between the gunwale G or other lateral support of the watercraft W and the tower 10. This force can have the effect of making it easier to raise the tower 10 (in a direction opposite arrow A of FIGS. 4 and 5) or can decrease a force with which the tower 10 moves downward when being collapsed.

Furthermore, the driver 70 is preferably in the form of an energy storage device which stores up energy when the tower 10 is in a collapsed configuration (FIG. 4) and releases that energy as the tower 10 transitions from the collapsed configuration (FIG. 4) toward the raised configuration (FIG. 5). Release of energy from the driver 70 when functioning as an energy storage device can minimize the amount of force required to raise the tower 10. In particular, in one embodiment the driver 70 is in the form of a spring, such as a helical compression spring, which gets compressed when the driver 70 is collapsed (FIG. 6) and which releases energy when the driver 70 is extended (FIG. 7).

The driver 70 can generally be considered to have a first end 72 pivotably coupled to the follower element 40, such as through the rib 45, and a second end 74 where the driver 70 is pivotably attached to the reference element 30, such as through the tab 33. A shaft 76 is associated with the first end 72 and extends into an active element 78 of the driver 70. This active element 78 could be a spring or other active element to provide the force application and/or energy storage function for the driver 70.

The active element 78 could be some other form of spring than a helical compression spring, such as a resilient mass. The active element 78 could also be a compressed pneumatic cylinder which would store energy in the form of compressed air or other gas within the active element 78. This supply of compressed gas could alternatively (or in addition) be supplied so that the source of compressed gas would allow the driver 70 to apply additional force for assistance in raising the tower 10.

The active element 78 could be in the form of a hydraulic cylinder coupled to a hydraulic circuit such as including a pump and reservoir, as well as a valve, so that the hydraulic circuit could be activated with the valve to cause the hydraulic cylinder to either assist in raising the tower 10 or supply all of the force required for raising of the tower 10. The active element 78 could also be in the form of some kind of jack, such as a mechanical screw jack which would have a handle which could interface with the active element 78 and be cranked to extend the shaft 76 and cause the driver 70 to exert a force on the follower element 40 relative to the reference element 30. Such a screw jack could be driven by an electric motor as well, so that the tower 10 could be automatically raised or lowered through forces exerted by such an electric motor. The electric motor could have an output shaft which directly drives a threaded shaft aligned with the shaft 76. As an alternative, some form of gears could be utilized for interfacing the shaft 76 to the electric motor.

In one form of the invention, the driver 70 is in the form of both a spring as an active element 78 and a pneumatic cylinder in the form of a damper. In such a configuration, not only is energy storage associated with the spring facilitated, but also any undesirable bouncing associated with the spring, or bouncing associated with travel of the watercraft W, such as when on a trailer and being transported, could be attenuated by operation of such a damper. Also, the damper would slow down a rate at which the tower 10 can be raised or lowered so that the tower 10 can be raised or lowered in a more controlled fashion.

While the driver 70 is shown extending between the reference element 30 and follower element 40, the driver 70 could be interposed between any two elements of the four-bar linkage making up the joint 20. For instance, the driver 70 could be in the form of a helical torsion spring surrounding one of the pins 55, 65 to supply a biasing force tending to bias the associated joint toward a particular configuration.

In use and operation, and with particular reference to FIGS. 4 and 5, details of the operation of the tower 10 and joint 20 of this invention are described, according to this most preferred embodiment. The tower 10 would typically initially be collapsed (FIG. 4) with the joint 20 configured as shown in FIG. 4. The driver 70 has been collapsed and is storing energy, such as within a spring. Typically, some form of lock can also be provided which prevents the tower 10 from inadvertently rising. Such a lock could be in the form of a removable pin extending between overlapping portions of adjacent links within the joint 20 at a location spaced from the pins 55, 65. As an alternative or in addition, some portions of the tower 10 spaced from the joint 20 could merely be tied down to a portion of the watercraft W.

When one wishes to raise the tower 10 (in a direction opposite arrow A of FIGS. 4 and 5) one merely supplies a lifting force on any portion of the tower 10. The spring within the driver 70 (or other force application element within the driver 70) assists the user so that the user uses less energy than the total amount of energy required to lift the tower 10. Once the tower 10 has been fully raised (FIG. 5) another lock device (such as a locking pin selectively joining the elements) can be utilized to keep the tower 10 in this raised configuration.

When a user desires to lower the tower 10 this process is reversed to lower the tower 10 (along arrow A of FIGS. 4 and 5). As this downward force is applied to the tower 10, the follower element 40 rotates (about arrow F of FIG. 4) and the short link 50 rotates (about arrow H of FIG. 4). The long link 60 only pivots a small amount to facilitate the motion of the follower element 40 and short link 50. Such long link 60 motion might be in a single direction or actually involve some motion in both directions (along arrow J of FIG. 4). Such motion is also depicted in the context of the joint 20 alone in FIG. 6.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. For instance, the entire tower 10 and joints 20 can be reversed to facilitate collapsing toward the stern S, rather than toward the bow B. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element; and wherein said pair of substantially rigid links includes a short link shorter in length than a long link.

2. The watercraft of claim 1 wherein said links are pivotably attached to ends of said reference element and ends of said follower element with said links spaced from each other by a distance similar to a length of said reference element and said follower element.

3. The watercraft of claim 2 wherein said short link of each said joint is configured as a pair of substantially parallel links pivotably attached to an end of said follower element through a common pin and an end of said reference element through a common pin.

4. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element;

wherein a driver is associated with each said joint, said drivers adapted to apply a force between said gunwales of the watercraft and said follower elements of said joints; and wherein said driver includes a spring, said spring storing energy when said tower is lowered and releasing energy when said power is raised, such that an amount of energy required to raise said tower is at least partially supplied by said spring.

5. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element;

wherein a driver is associated with each said joint, said drivers adapted to apply a force between said gunwales of the watercraft and said follower elements of said joints; and wherein said driver includes a pneumatic cylinder, said pneumatic cylinder adapted to apply a force between said gunwales of said watercraft and said followers of said joints to vary an amount of force required to move said tower relative to said gunwales.

6. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element;

wherein a driver is associated with each said joint, said drivers adapted to apply a force between said gunwales of the watercraft and said follower elements of said joints; and wherein said driver includes a mechanical jack, said jack configured to apply a force between one of said gunwales and said follower element of one of said joints.

7. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element;

wherein a driver is associated with each said joint, said drivers adapted to apply a force between said gunwales of the watercraft and said follower elements of said joints; and wherein said driver includes a threaded element and an electric motor, said threaded element configured to cause said follower of said joint to move relative to said gunwale when said electric motor causes a shaft of said threaded element to rotate, such that said electric motor provides power for movement of said tower relative to said gunwales.

8. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element;

wherein a driver is associated with each said joint, said drivers adapted to apply a force between said gunwales of the watercraft and said follower elements of said joints; and wherein said driver extends from a point on said follower between ends of said follower and a point on said reference between ends of said reference.

9. A watercraft with a collapsible water sports tower, the watercraft comprising in combination:

a pair of gunwales on lateral sides of said watercraft;

a tower including a cross member portion and at least two upright portions extending from said cross member portion down to lower ends;

a pair of joints adapted to pivotably attach said lower ends of said at least two upright portions to said gunwales;

each said joint including a follower element fixed to said lower ends of each of said upright portions on a common side of said tower;

each said joint including a reference element fixed to one of said gunwales;

a pair of substantially rigid links pivotably connecting separate portions of said follower element to separate portions of said reference element;

wherein a driver is associated with each said joint, said drivers adapted to apply a force between said gunwales of the watercraft and said follower elements of said joints; and wherein said driver is coupled to at least two elements taken from the group of elements including: said follower, said reference and said pair of links; such that movement of said driver causes movement of associated elements adjacent said driver, and causing said follower to move relative to said reference and causing said tower to move relative to said gunwales.

10. A collapsible tower for a vehicle, the collapsible tower comprising in combination:

a cross member;

at least two upright portions extending from said cross member down to lower ends;

a pair of joints adapted to pivotably attach said lower ends of said at least two uprights to lateral portions of the vehicle;

each upright portion having each associated lower end thereof remain attached through said joints to the vehicle throughout pivoting motion of said tower relative to the vehicle;

wherein a driver is associated with each said joint, said driver adapted to apply a force between the vehicle and portions of said joints attached to said lower ends of said upright portions of said tower;

wherein said joint includes a follower element fixed to each of said lower ends of each of said upright portions which are located on a common side of said tower; and said driver extends from a point on said follower between ends of said follower and a point attached to the vehicle.

11. The tower of claim 10 wherein each said joint includes a follower element fixed to each of said lower ends of each of said upright portions which are located on a common side of said tower.

12. The tower of claim 11 wherein each said joint includes a pair of link elements, each said link element pivotably connecting separate portions of said follower element to the vehicle.

13. The tower of claim 12 wherein a reference element is provided opposite said follower element, said reference element adapted to be attached to the vehicle, said pair of links pivotably attached to said reference element on portions of said reference element spaced from each other.

14. A method for articulating a collapsible tower relative to a vehicle to which it is mounted, the method including the steps of:

providing a collapsible tower including a cross member, at least two upright portions extending from the cross member down to lower ends, a pair of joints adapted to pivotably attach the lower ends of the at least two uprights to lateral portions of the vehicle, and each upright portion having each associated lower end thereof remain attached through the joints to the vehicle throughout pivoting motion of the tower relative to the vehicle;

keeping each of the lower ends of each of the uprights attached through the joint to a portion of the vehicle throughout articulating motion of the tower relative to the vehicle;

wherein said providing step includes the step of configuring the joint to include a follower wherein the joint includes a follower element fixed to the lower ends of each of the upright portions on a common side of the tower, including a pair of links in the joint, each link element pivotably connecting separate portions of the follower element to the vehicle, and providing a reference element wherein the reference element is opposite the follower element, the reference element attached to the vehicle, the pair of links pivotably attached to the reference element on portions of the reference element spaced from each other;

interposing a driver between at least two elements of the joint taken from the group of elements including: the follower, the reference and the pair of links; and configuring the driver to store energy when the tower is lowered and release energy when the tower is raised, such that an amount of energy required to raise the tower is at least partially supplied by the driver.

* * * * *